US007000826B2

(12) United States Patent
Billings

(10) Patent No.: US 7,000,826 B2
(45) Date of Patent: Feb. 21, 2006

(54) MAIL BOX CADDIE

(76) Inventor: James O. Billings, 381 Winecoff St., Troutman, NC (US) 28166

( * ) Notice: Subject to any disclaimer, the term of this patent is extended or adjusted under 35 U.S.C. 154(b) by 185 days.

(21) Appl. No.: 10/730,310

(22) Filed: Dec. 5, 2003

(65) Prior Publication Data

US 2005/0121503 A1 Jun. 9, 2005

(51) Int. Cl.
*B65D 91/00* (2006.01)

(52) U.S. Cl. ..... 232/29; 232/17

(58) Field of Classification Search ..... 232/29, 232/33, 17, 45

See application file for complete search history.

(56) References Cited

U.S. PATENT DOCUMENTS

| | | | | | |
|---|---|---|---|---|---|
| 34,065 | A | * | 1/1862 | Crane | 431/251 |
| 3,113,680 | A | * | 12/1963 | Frater et al. | 211/126.4 |
| 3,252,614 | A | * | 5/1966 | Evans | 206/509 |
| 3,259,269 | A | * | 7/1966 | Asenbauer | 206/509 |
| 4,160,520 | A | * | 7/1979 | Cluthe | 232/17 |
| 4,389,777 | A | * | 6/1983 | Landsberger | 30/324 |
| 4,600,143 | A | * | 7/1986 | Harlow et al. | 232/17 |
| 4,714,192 | A | * | 12/1987 | Harlow et al. | 232/17 |
| 4,753,385 | A | * | 6/1988 | Phipps et al. | 232/17 |
| D305,410 | S | * | 1/1990 | Tyler | D9/425 |
| 4,896,827 | A | * | 1/1990 | Economou | 232/17 |
| D310,748 | S | * | 9/1990 | Embree et al. | D3/304 |
| 5,009,366 | A | * | 4/1991 | van Druff et al. | 232/17 |
| 5,060,900 | A | * | 10/1991 | Kokoruda et al. | 248/311.2 |
| 5,083,703 | A | * | 1/1992 | Blyakharov | 232/17 |
| D327,561 | S | * | 6/1992 | Hradisky | D3/307 |
| 5,765,749 | A | * | 6/1998 | Harper | 232/17 |
| 6,109,519 | A | * | 8/2000 | McClure | 232/17 |
| D436,728 | S | * | 1/2001 | Harding | D3/304 |
| 2002/0109005 | A1 | * | 8/2002 | Billings | 232/29 |

* cited by examiner

*Primary Examiner*—William L. Miller

(57) ABSTRACT

A Mailbox Caddie for reception and containment of pieces of mail, fully insertable into an individual standard Post Office mailbox. The tray consists of an economic, one piece molded plastic part, integrating all functional and aesthetically features, to match the Mailbox Caddie having four sides, which form an almost hollow parallelepiped, except for its front end, which is open, with both sides left and right tapered towards the front. The front edge base has a round lip and a sponge rubber adhesive pad to ease its handling. The base has three central ribs, raised from the bottom, to brace the length of the tray and raise the pieces of mail from the bottom of the base around the three up right sides, with an outer extended perpendicular edge also reinforcing the tray. When the tray is pulled out so far that it pivots on the front of the box, the outer back corners of the perpendicular upper edge limit the pivoting angle of the Mailbox Caddie as it is removed.

1 Claim, 6 Drawing Sheets

CROSS SECTION A.A

MAIL BOX CADDIE

TECHNICAL FIELD

This invention relates to an improved, one piece manufactured insertion tray, called a "Mailbox Caddie". Such a caddie freely fits into a standard, postal Mailbox approved by the United Postal Service. This tray allows the front lid of the box to be totally closed after insertion of the mail. Such an economical device is advantageous over other existing trays due to its cost effective manufacturing. The Mailbox Caddie, made of simple, durable flat plastic, machine formed to its specific final shape, is beneficial to society. In part, this is due to the improved expeditious mail handling, and better weather protection for every one, especially handicapped persons. Considering the huge amounts of important mail that is delivered to over a hundred million individual homes, stores, farmhouses, and businesses every day, this innovation is of great benefit to society and, thus, is an advance in the art of mail handling.

BACKGROUND AND PRIOR ART

The enormous amount of mail transferred daily through Post Office boxes, requires both the utmost care and attention of the people who insert it, and the owner who retrieves it. Considering that these letters and packages have progressively quadrupled in numbers for the last 20 years, and are a mixture of both less and more significant mail, the improvement of its handling has become a necessity. Mail that is valuable to its recipient, such as personal correspondence, bills, medical payments, official government notifications, insurance data etc., is important in keeping an informed, organized existence in our lives. There are also large amounts of correspondence that come in over-sized pieces of mail, including advertisements, political information, letters, booklets, and charitable support drives, which have become a large part of the everyday mail. Since it is important that no piece of mail get lost, a caddie tray with its light, yet sufficient strength, is both easy and comfortable to handle, allowing quick accessibility for mail package retrieval. The US Post Office requires the mailbox to be on the edge of the road at an exact distance, which constitutes a hazard for the retriever in times of heavy traffic. The benefit of the Mailbox Caddie is to allow one to remove the contents and get into a safe area quickly. In many cases the mail may be removed from the window of an automobile which can be very helpful, especially for the handicapped.

PRIOR ART

The basic concept of an inserted drawer of similar designs exists and is covered in many patented drawers. Following is a review of several of them, none of which compared to the new disclosed Mailbox Caddie. Following a patent search, several insertable trays were found and discarded for the following reasons:

U.S. Pat. No. 4,160,520—1974 by Cluthé, shows a two piece insertable tray, assembled by a transverse hinge. This drawer is a unique design that is non-standard and it is fitted to a custom made mailbox with regards to the cover and bottom, and cannot be retrofitted to standard mailboxes. Such a device does not allow the use of the existing standard mailbox. The drawer is not removable because of the assembling and has five (5) sides with its fail-safe internal mechanism.

U.S. Pat. No. 4,600,143—1986 by Harlow & Felske, shows a one-piece, molded, plastic having two integral tabs 52 forbidding the insert tray to exit. Collapsible front edges 48 & 58 require a precise tool to form a flexible edge, and allows these edges to collapse as the lid is closed. Such a fold has a limited life expectancy. Also, the concept of the paralleled ribbed bottom alignment, along the length of the above patent sheet 40, does not take into account the possibility of water accumulation on the bottom of the box, thus wetting the contents when the mail is caught between one of the ribs. This is remedied in the proposed new Mailbox Caddie design. The restriction of not being able to easily remove the tray from the box requires the mail to be handled and removed from the front, further exposing the contents to bad weather and the risk of spilling it. The new concept of Mailbox Caddie is less costly to manufacture and does improve the means of quickly and safely picking up the mail as a package.

U.S. Pat. No. 4,714,192—1987 Harlow, Jr. et al, is a patent similar to U.S. Pat. No. 4,600,143—1986 with its previously sited disadvantages and are the same as compared to U.S. Pat. No. 4,753,385—1988 Phipps, Thompson & Benedict. The tray, requiring extensive hinge forming tooling, also requires the customer to form and tab assemble the tray himself, which can be difficult. Unless the tray is made of resilient plastic, the sides will not remain flat. It has a series of holes for drainage, yet the length of the grooved rib accommodates pieces of mail edges and only partially restrains wetness. This design concept is not comparable to the Mailbox Caddie for reasons cited further on.

U.S. Pat. No. 4,896,827—1990 George Economou, this mailbox insert does not fit Standard, recognized Post Office approved mailboxes and requires one to purchase both the mailbox outer shell and the drawer. The drawer itself will tilt forward when drawn forward; the string will limit its position, but has a tendency to let the mail go forward, meaning an extra wall is needed around the drawer. There is no allowance for excess rain to escape by the bottom hole, even though it has an overhang.

U.S. Pat. No. 5,009,366—1991 Albert van Druff & David Fussell, this patent is similar to U.S. Pat. No. 4,753,385 and has a tray made of heavy-duty paper or laminated stock material. The description just states "structure to be folded, forming an four-sided box with a tab anchored in the back. When inserted, such a tab stops it from being removed again. The fact that the handler must put it together is less desirable and does not assure a proper assembly each time and this is not comparable to the Mailbox Caddie, which has no such ambiguity.

BRIEF DESCRIPTION OF THE DRAWINGS

Sheet 1

Sheet 2

Figure 5:
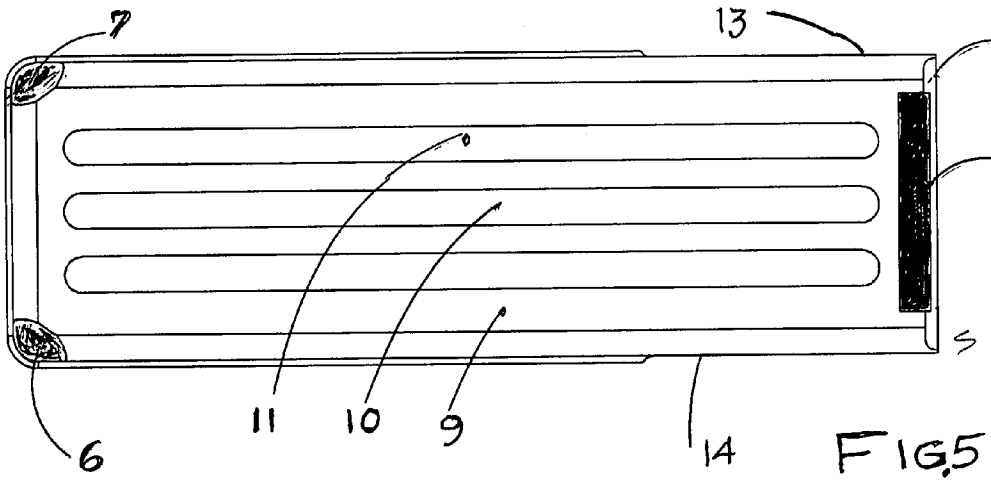
Figure 4:
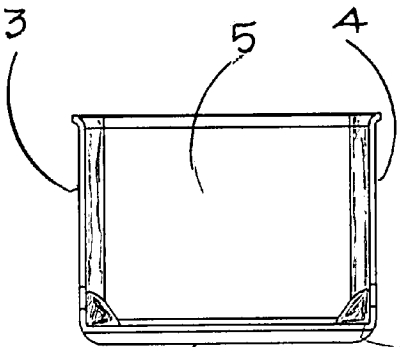
Figure 3:
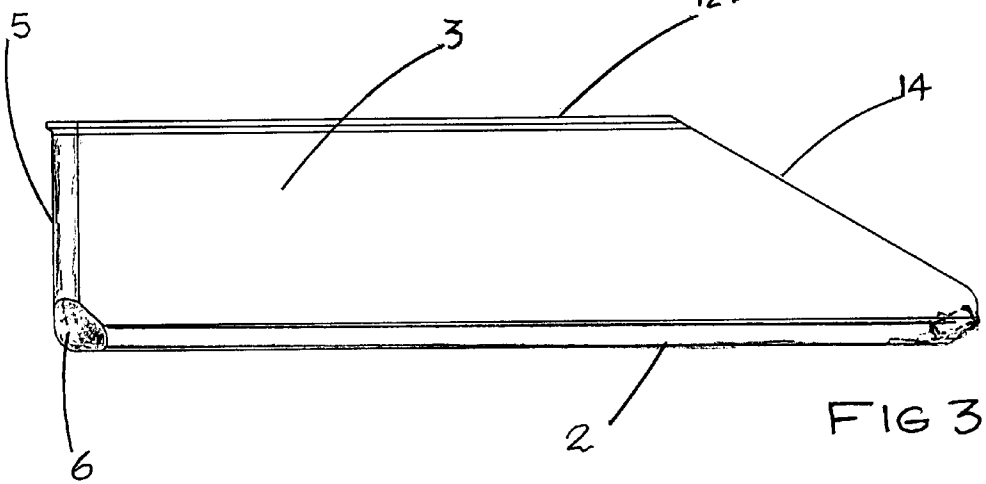

FIGS. 3, 4, 5 show three views of an orthographic projection of the Caddie tray.

FIG. 3 shows its left-hand elevation

FIG. 4 shows its front elevation.

FIG. 5 shows a top view of the tray with a foam rubber front pad bonded on the center edge.

Figures 6, 7:
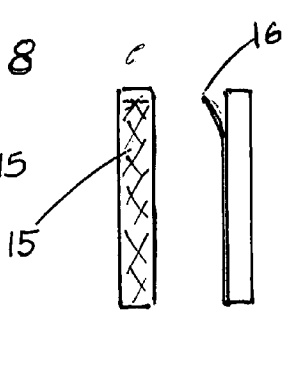

FIG. 6 shows a top view of the pad.

FIG. 7 shows a right-hand view of the pad 7, with a paper cover being slightly raised.

Sheet 3

Figures 8, 9:
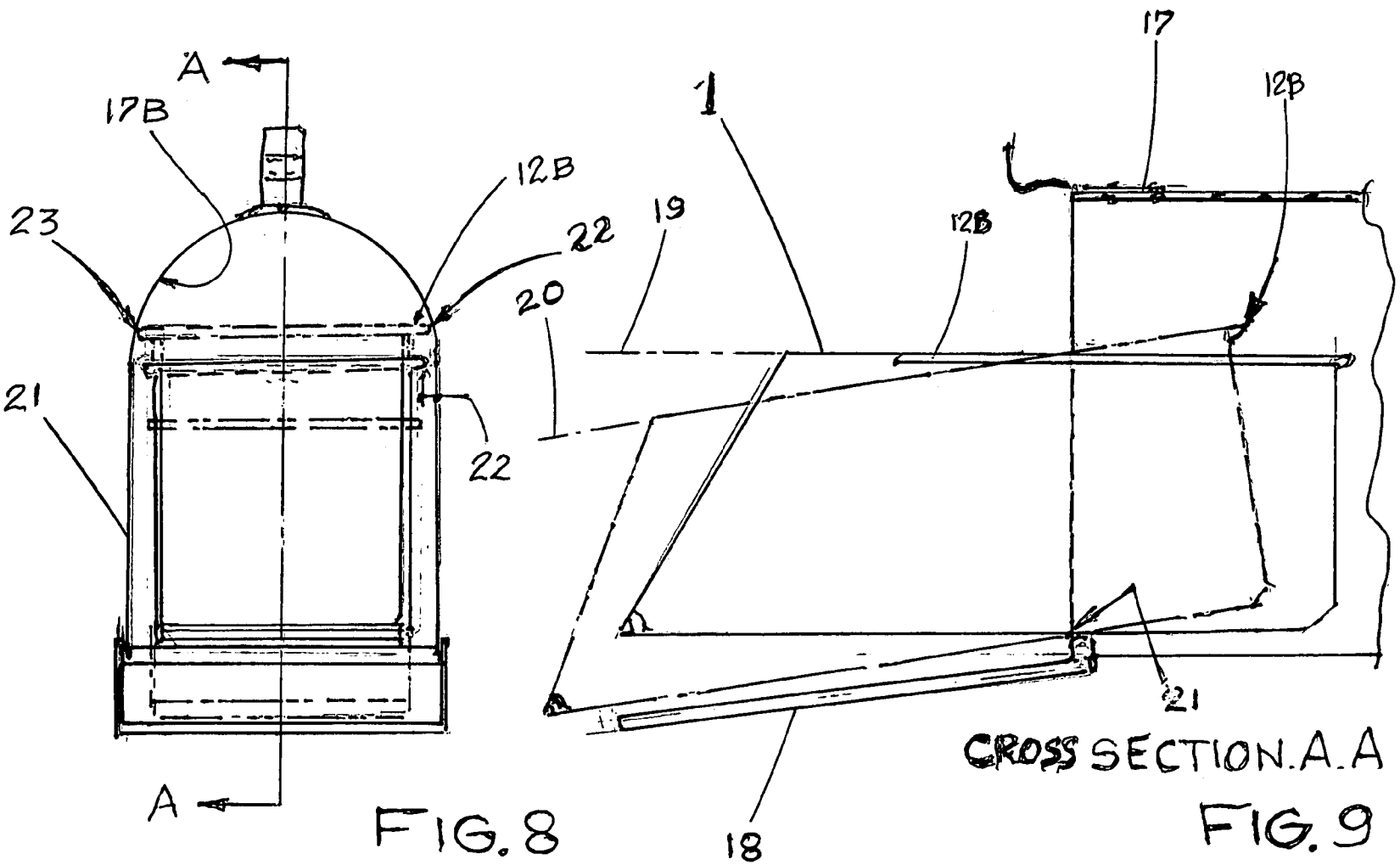

FIG. 8 shows a front view of the mailbox with the Caddie tray positioned partly out, at two levels FIG. 9 shows a right hand-view elevated cross section of view 8, with the tray pivoting on the bottom front door hinge.

Sheet 4

Figure 10:
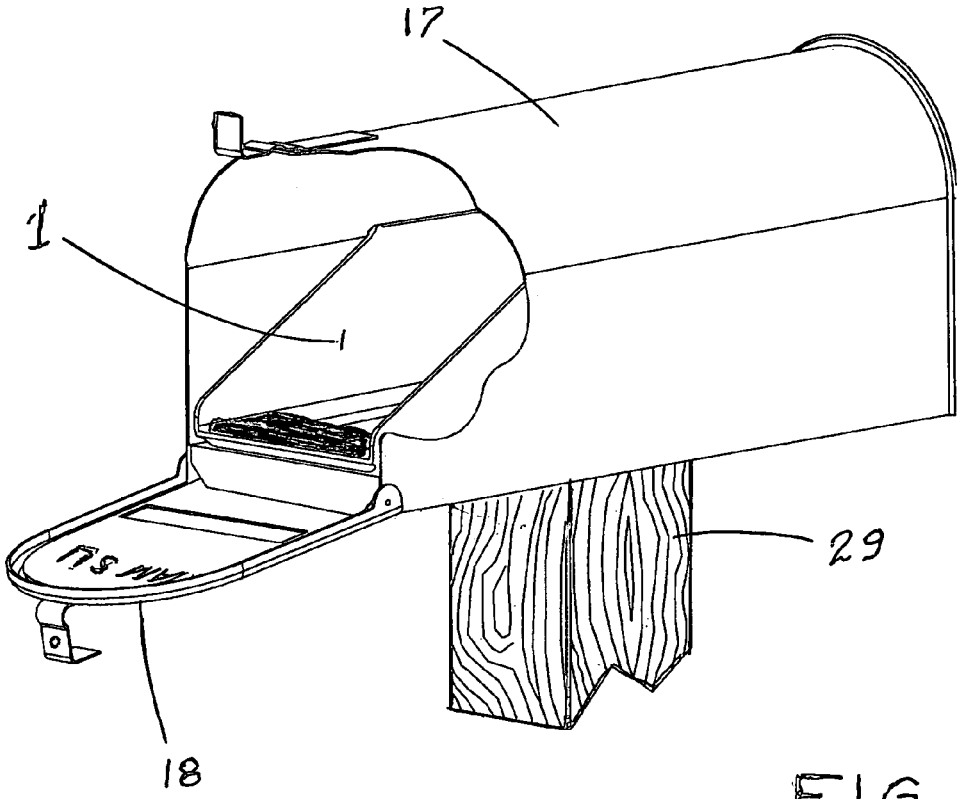

FIG. 10 shows a perspective view of the tray fully inserted into the box.

Figure 11:
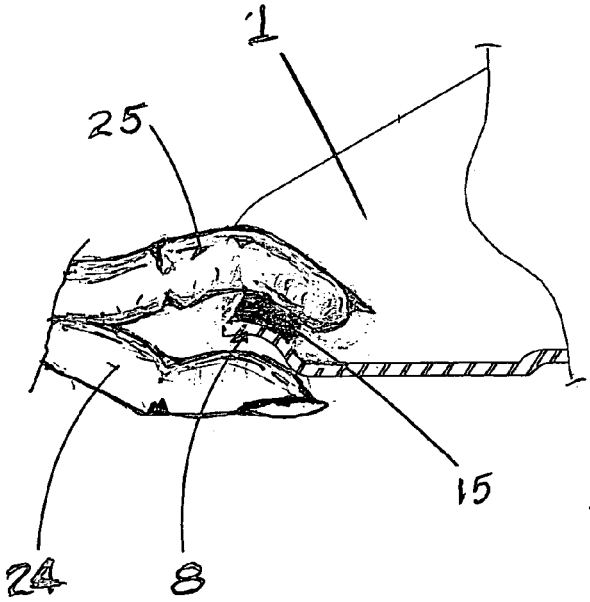

FIG. 11 shows how to handle the caddie tray with a front-end rubber pad for retrieving it.

Sheet 5

Figure 12:
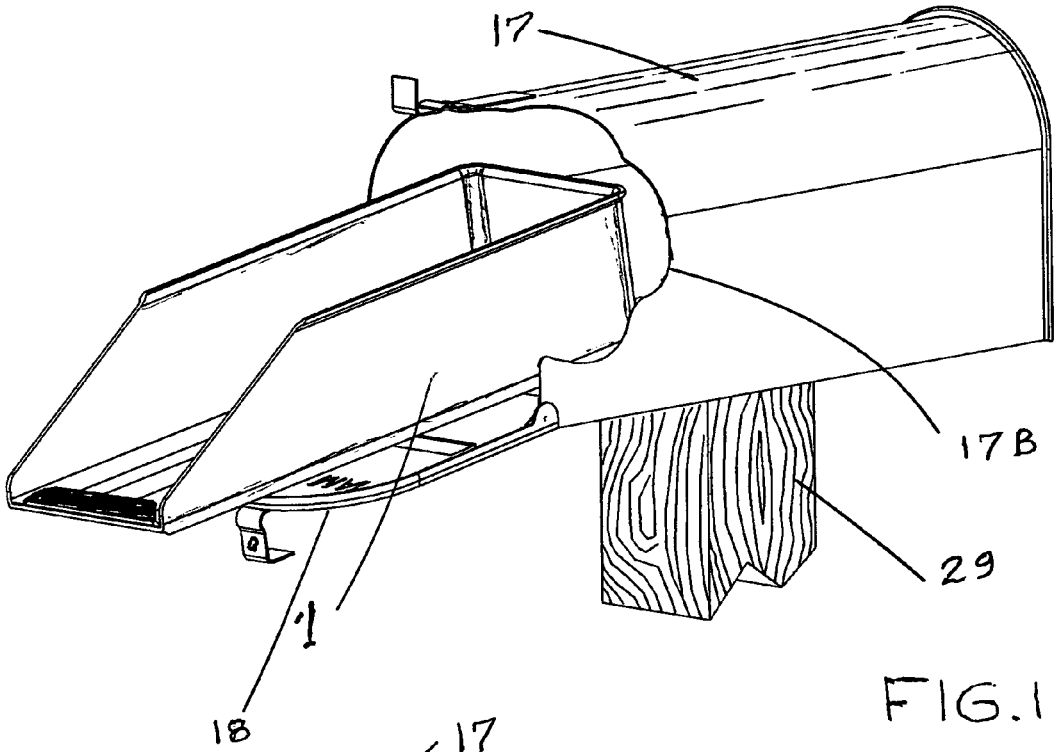

FIG. 12 shows a perspective drawing of the caddie tray, almost completely out of the box.

Figure 13:
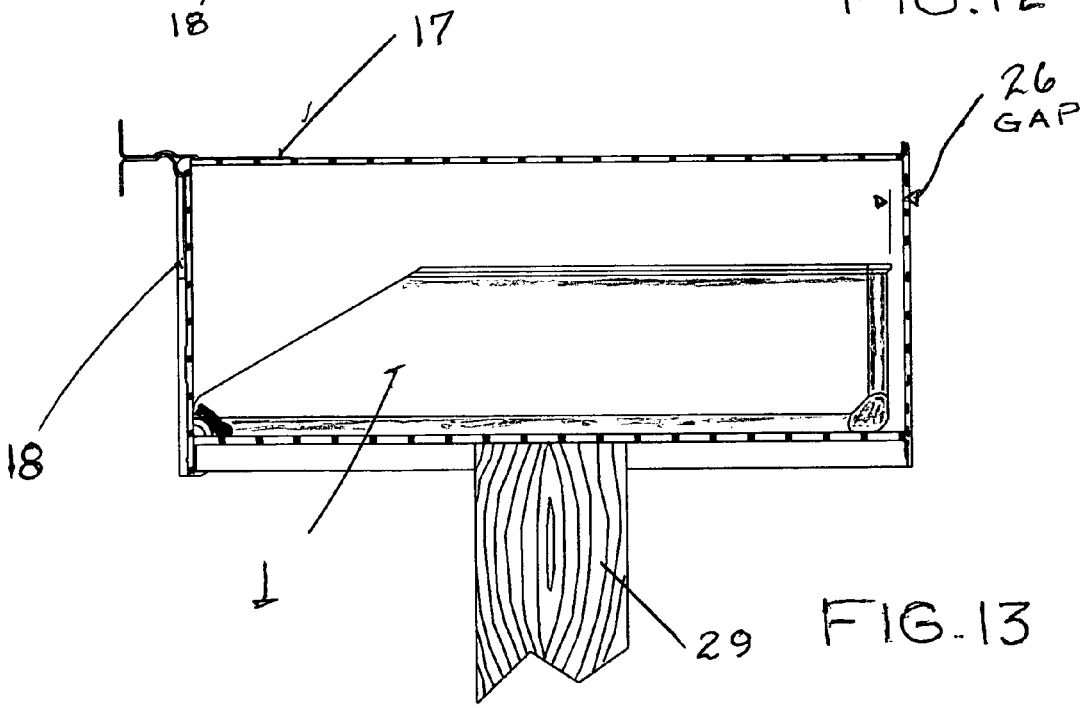

FIG. 13 shows the tray fully inserted into the box with the door of the mailbox closed.

Sheet 6

Figure 14:
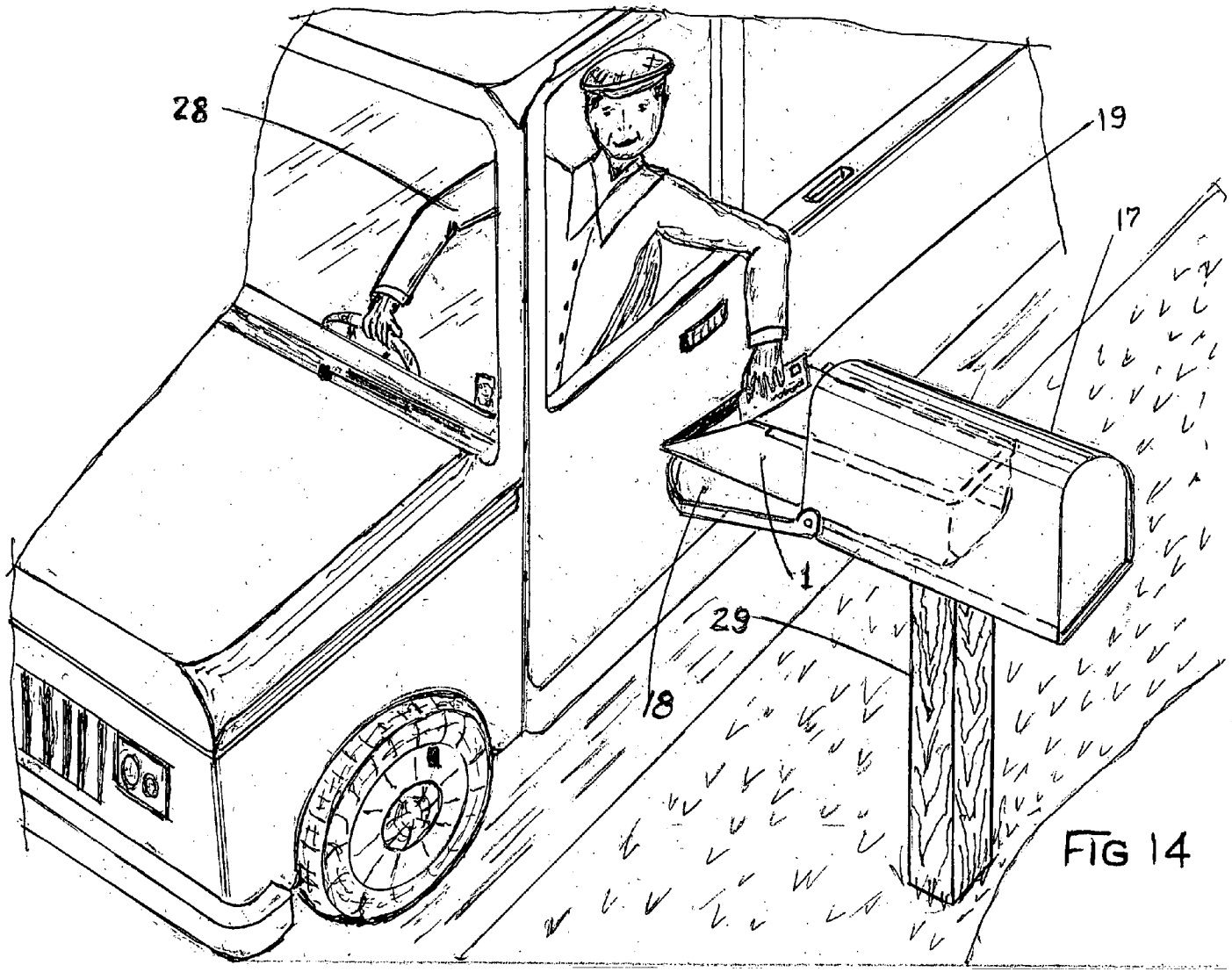

FIG. 14 shows a partial perspective of a pickup truck, stopped in front of a mailbox, with the driver retrieving the mail.

DETAILED DESCRIPTION OF PREFERRED EMBODIMENT

Figures 1, 2:
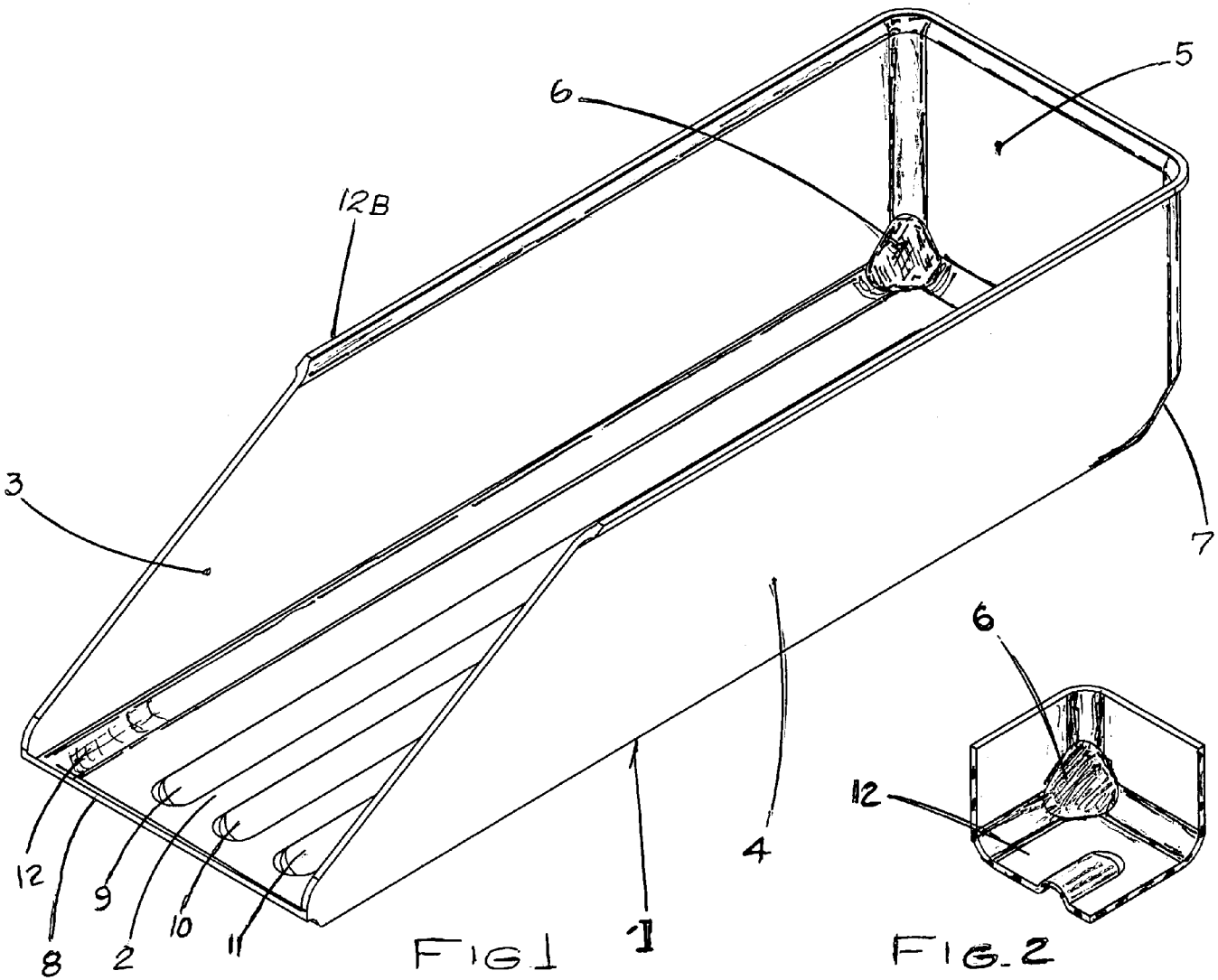
FIG. 1 shows a three dimensional upright perspective of the Caddie tray
FIG. 2 shows a cut out section of left bottom rear end corner.

Sheet 1, FIG. 1 The tray 1 consists of a formed plastic, which has a hollow opening parallelepiped with four sides; the base 2, the right hand side 4, the left hand side 3 and the rear side 5. The base 2 has three raised ribs 9,10 & 11 to strengthen the bottom lengthwise. All upright sides are connected to the base 5 by a continuous ½" radius 12, excepted for the two rear bottom corners 6 & 7 where two triangular reinforcing flats further improve the rigidity of the tray. The front of the base has a raised lip 8 on the open side. The lip profile forms a small upward curve across the base's front end. The sides 3 & 4 are tapered towards the front. A continuous flanged edge perpendicular to the side's outer edge reinforces the top of the three sides 3, 4 & 5.

FIG. 2 shows a partial cross-section of the left bottom inside rear corner 6. The right corner 7 is similar.

Sheet 2 shows an orthographic projection of the Caddie tray. FIG. 3 shows the left side elevation, which consists of sides 2, 3, and 5 with the upper flanged edge 12B, the tapered front 14 & the rear flat corner 6. FIG. 4 shows the open elevated front of the tray with four sides 2, 3, 4 & 5.

FIG. 5 shows a top view of the tray with its three reinforcing ribs 9,10 & 11. Also shown is a spongy rubber pad 15 bonded to the front edge 8. FIG. 6 shows a front detail of the spongy rubber 15. FIG. 7 shows a right-hand side view of 15 with an adhesive paper cover 16 partially raised at one end.

Sheet 3, FIG. 8 shows the front elevated view of the Caddie tray 1, partly inserted into the mail box 17 at two levels. FIG. 9 shows a right-hand cross section AA of the mailbox 17 with the box front door 18 fully open and the tray 1 shown in continuous line at a horizontal position 19. The tray 1 is also shown with a mixed line in a tilted forward 20 position, pivoting on the box's front edge 21. At this stage, it should be remarked that the tray's rear corners of the lip 12B, 22 & 23, FIG. 8 abut against the inside of the mailbox's domed curvature 17B. This avoids further tray tilting. Such a simple innovative feature allows expedient tray handling for either horizontal freedom or for stopping it on the tilt, due to the relative dimensions between the box and the tray's specific size.

Sheet 4 FIG. 10 shows the mailbox 17 supported by the wood post 29 with the door 18 open & the Caddie tray 1 fully inserted in the mailbox.

FIG. 11 shows a front partial section of the tray being picked up between two fingers, the thumb 24 & the fore-finger 25, squeezing the front edge 8 and the rubber pad 15.

Sheet 5, FIG. 12 Illustrates a perspective of the tray almost completely pulled out of the mailbox 17. A cutout on the front right side 17B discovers the tray's rear end.

FIG. 13 shows an elevated longitudinal cross section of box 17. The door is closed and the Caddie tray fits inside with a small clearance 26 still remaining.

Sheet 6, FIG. 14 shows a left-hand side in perspective of a partial truck 27, with its door closed set in front of the postal mail box 17 with the door 18 open. The perspective shows a driver 28 sitting in the truck retrieving his mail 19. Such a convenience also allows removing the tray and its content completely away from the box.

What is claimed is:

1. In combination, a one piece integrally molded plastic tray, and a mailbox having a front door, the combination comprising:

the tray having a rectangular profiled bottom surrounded by three elevated sides and an open front end for mail insertion and removal, the sides defining a left side, right side, and rear side;

the sides including at the top thereof a continuous flanged edge for rigidity;

the tray removably located inside the mailbox and sized such that there is clearance between the rear side of the tray and the rear of the mailbox when the mailbox door is closed;

the tray has three equally raised ribs on the bottom and two triangular rear bottom corners for rigidity;

the tray has approximately a ½" radius around the inside periphery joining the three sides to the bottom and blending into the triangular corners thereby allowing the tray to be manufactured from a thin sheet of plastic while providing sufficient rigidity;

the front of the tray bottom including a raised lip defining a handle; and a ⅛" thick soft rubber pad adhesively attached to the handle to prevent the users' fingers from slipping from the handle when extending the tray from the mailbox to retrieve the mail.

* * * * *